US011766104B1

(12) United States Patent
Hood et al.

(10) Patent No.: US 11,766,104 B1
(45) Date of Patent: Sep. 26, 2023

(54) UNIVERSAL WRAP-AROUND GARMENT BAG

(71) Applicants: Nicole Marie Hood, Maitland, FL (US); Thomas William Hood, Maitland, FL (US)

(72) Inventors: Nicole Marie Hood, Maitland, FL (US); Thomas William Hood, Maitland, FL (US)

( * ) Notice: Subject to any disclaimer, the term of this patent is extended or adjusted under 35 U.S.C. 154(b) by 447 days.

(21) Appl. No.: 16/988,070

(22) Filed: Aug. 7, 2020

Related U.S. Application Data

(60) Provisional application No. 62/884,393, filed on Aug. 8, 2019.

(51) Int. Cl.

| | |
|---|---|
| ***A45C 3/00*** | (2006.01) |
| ***A45C 13/10*** | (2006.01) |
| ***A45C 13/30*** | (2006.01) |
| ***A45C 13/12*** | (2006.01) |

(52) U.S. Cl.
CPC ..... *A45C 3/004* (2013.01); *A45C 13/103* (2013.01); *A45C 13/1069* (2013.01); *A45C 13/1092* (2013.01); *A45C 13/12* (2013.01); *A45C 13/30* (2013.01); *A45C 2013/306* (2013.01)

(58) Field of Classification Search
CPC ... A45C 3/004; A45C 13/103; A45C 13/1069; A45C 13/1092; A45C 13/12; A45C 13/30; A45C 2013/306; A45C 7/0086
USPC ..... 190/108, 115; 206/287.1
See application file for complete search history.

(56) References Cited

U.S. PATENT DOCUMENTS

| | | | | |
|---|---|---|---|---|
| 3,729,038 | A | 4/1973 | Ekeson | |
| 4,170,282 | A | 10/1979 | Schwartzstein | |
| 4,206,835 | A | 6/1980 | Shapiro | |
| 4,420,068 | A | 12/1983 | Gerch | |
| 4,598,803 | A | 7/1986 | Ghiassi | |
| 4,655,343 | A | 4/1987 | Lane et al. | |
| 4,693,368 | A | 9/1987 | King et al. | |
| 4,817,791 | A | 4/1989 | Adams | |
| 5,031,766 | A | 7/1991 | Cohen | |
| 5,255,765 | A * | 10/1993 | Schrecongost ..... | A45C 13/002 150/154 |

(Continued)

OTHER PUBLICATIONS

"Bankroll Rolling Luggage with Garment Bag" found at https://www.josbank.com.

*Primary Examiner* — Jennifer Robertson
*Assistant Examiner* — Justin Caudill
(74) *Attorney, Agent, or Firm* — The Patent Professor, P.A.; John Rizvi

(57) ABSTRACT

A universal, wrap-around garment bag including a zippered storage compartment for storing garments therein, a plurality of adjustable straps including quick release fasteners for attaching the wrap-around garment bag to the outer surface of any suitcase, and openings provided at opposite ends of the garment bag for receiving hooks of garment hangers employed at opposite ends of the garment bag to maximize the ability to store more clothes in the storage compartment. In one embodiment, each garment hanger includes a S-shaped hook that slides through an aperture formed within the neck of each garment hanger to removably store the S-shaped hooks within the garment bag, or a conventional garment hanger having a standard curved hook.

20 Claims, 11 Drawing Sheets

(56) References Cited

U.S. PATENT DOCUMENTS

| | | | | |
|---|---|---|---|---|
| 5,566,797 | A | 10/1996 | Van Himbeeck | |
| D429,419 | S * | 8/2000 | Barraco | D3/318 |
| 7,140,479 | B2 | 11/2006 | Mangano et al. | |
| 7,207,426 | B2 | 4/2007 | Godshaw et al. | |
| 7,416,066 | B2 | 8/2008 | Chernoff | |
| D667,635 | S * | 9/2012 | Sanchez | D3/318 |
| D730,058 | S * | 5/2015 | Hazlewood | D3/318 |
| 2004/0173427 | A1 | 9/2004 | Chernoff | |
| 2005/0284717 | A1 | 12/2005 | Chernoff | |
| 2017/0020250 | A1 | 1/2017 | Boschan | |

* cited by examiner

UNIVERSAL WRAP-AROUND GARMENT BAG

CROSS REFERENCE TO RELATED APPLICATIONS

This application claims the benefit of U.S. Provisional Pat. Application Serial No. 62/884,393, filed on Aug. 8, 2019, which is incorporated herein in its entirety.

FIELD OF THE INVENTION

The present invention relates generally to garment bags or luggage, and more particularly, to a universal, wrap-around garment bag that is detachably fastened to the outer surface of any suitcase for storing and transporting garments in a wrinkle-free manner without the hassle and burden of carrying and transporting a garment bag with one hand, and a suitcase with the other.

BACKGROUND OF THE INVENTION

Retail stores generally sell a variety of luggage that is used to carry and transport garments and personal items when traveling on vacation, taking business trips, or when permanently moving from one place to another. The term luggage often entails a broad depiction of suitcases comprising various styles, shapes, and sizes that are used for a variety of different occasions by young and old alike. For example, some suitcases have a pliable or hard rigid outer body, include wheels, and have fixed carrying handles, and a variety of external storage pockets for storing personal items. Over time, more modem features have been added to better accommodate travelers needs and provide added convenience when traveling. For example, modern suitcases typically include a telescoping handle that retracts and extracts within the suitcase or bag, include rotating wheels to make it easier for users to roll the suitcase over a surface, include compact folding stools to allow travelers to sit on during use, and provide electronic features such as universal serial bus USB connectors, and battery charger to electrically connect and charge smartphones. Most suitcases are generally sized to provide greater space to accommodate packing more clothes. However, as a result of cramming the clothing into a storage compartment having limited space, it is not uncommon for travelers to arrive at their destination only to find that the care they took when packing the clothes was to no avail as the clothes or garments are often wrinkled and in disarray. In effort to help alleviate this issue, many individuals opt to pack clothing in separate suitcases to help lessen the weighted compression of the packed clothes. This approach however, imposes the need for added luggage when traveling and can lead to increase costs when boarding an airplane where airlines commonly restrict the amount and size of baggage a person can carry on the plane, forcing travelers to pay for check-in baggage.

Another type of luggage that is often used by many individuals is a garment bag. Garment bags are generally designed to store and carry a limited amount of clothes when going on short trips whether for pleasure or business. Conventional garment bags are generally smaller in size than suitcases, and typically include a shoulder strap, and one or more handles for carrying and transporting the garment bag over a traveler's shoulder, or by hand during use. Such garment bags come in a variety of different shapes and colors, and are often constructed from leather, plastic, fabric, or a vinyl material. It is common practice for many travelers to employ the use of larger sized suitcases in addition to a garment bag when traveling. The garment bag allows travelers to pack selected clothes separately from clothing stored in the suitcase to provide immediate availability and prevent wrinkles. Thus, it is often the case, such as in airports, you see travelers transporting or carrying a suitcase with one hand, while carrying or shouldering a garment bag. Negotiating a larger suitcase and garment bag at the same time, is strenuous on the body, makes it harder for travelers to maneuver in crowds, is uncomfortable, and inconvenient when having to visit a restroom or simply when sitting. For example, individuals are often seen in airports, with a garment bag being held on a person's shoulder while the person is utilizing the urinal. Also when sitting, travelers often position the suitcase in close proximity, and rest the garment bag loosely on top of the suitcase while constantly having to reposition the garment bag over the suitcase as a result of the garment bag sliding off. Also, conventional garment bags typically comprise a general, rectangular shape that minimizes the number of garments that can be stored in the bag.

Manufacturers have attempted to solve the problems associated with carrying multiple pieces of luggage, and the need for packing clothes in a wrinkle-free manner when traveling. In doing so, some suitcase are designed to include one or more fold-out, rigid panels that are often provided within the confines of the suitcase. Fold-out panels typically include a rectangular, rigid panel having a peripheral edge attached to an inner surface of the suitcase, and includes adjustable straps for retaining clothing, such as suits or dresses, to the rigid panel to maintain the clothes in a taught, laid-out fashion to prevent wrinkles. Some manufactures have also retained the benefit of garment bags by incorporating them directly within the suitcase itself to permit larger or oversized garments to be stored within the suitcase. There are several drawbacks associated with such fold-out panels, and the inclusion of garment bags within suitcases. First and foremost, such designs do little to avert creases and wrinkles that form within the clothes as a result of the added weight of packing a larger quantity of clothes in the small confines of the suitcase, and man-handling or shuffling of the suitcase during transport by both travelers and employees of transportation industries. Further, the enclosed garment bag generally takes up space within the interior of the suitcase thus reducing the size of the storage compartment, forcing travelers to pack clothing in a much smaller, compact space. As such, incorporating a garment bag within the confines of a suitcase does very little to thwart unwanted wrinkles, or free up storage space for packing additional clothing.

Accordingly, there is an established need for a universal, wrap-around garment bag that is easily and quickly attachable to suitcases of any style, shape and size, that does not obstruct the operation of wheels or telescoping handles provided on the suitcases, provides an unobstructed planar surface on the suitcase for engaging with transport belts and overhead bins of airplanes, allows storing garments in a wrinkle-free manner, and is dimensioned and configured to maximize the number of garments that can be stored within the garment bag while allowing hanging the garment bag from either opposite end during use.

SUMMARY OF THE INVENTION

The present invention is directed to a universal, wrap-around garment bag including a first panel that is attached to a second panel defining a zippered storage compartment for storing garments therein, a storage pocket for storing small personal items, a plurality of adjustable straps including a quick release male/female buckle for attaching the wrap-around garment bag to the outer surface of any suitcase. One or more garment hangers may be employed at opposite ends of the garment bag where the one or more garment hangers include S-shaped hooks that translate through hook openings provided on opposite sides of the garment bag to store the hooks within the garment bags, or conventional garment hangers having a curved hook.

A first embodiment of the invention provides a wrap-around garment bag comprising: a first panel attached to a second panel by a stitched seam extending around a section of a perimeter of the attached panels, and a zipper extending along three sides of another section of the perimeter of the attached panels in which the attached panels form a storage compartment for storing garments, a plurality of adjustable straps defining a first pair of straps, a second pair of straps, and a third pair of straps, each strap having a proximate end attached to the first panel, and a distal end including a quick release fastener, at least one hook opening formed within the attached panels and extending within the storage compartment for receiving the curved hook of a garment hanger, and wherein the wrap-around garment bag is attachable to an outer surface of a suitcase where the first pair of straps extend over a top surface of the suitcase and are releasably attached together via, the quick release fastener, the second pair of straps extend under a bottom surface of the suitcase and are releasably attached together via, another quick release fastener, and a third pair of straps that extend across a back surface of the suitcase and are releasably attached together via, another quick release fastener such that a central portion of the attached panels butt flat against a front surface of the suitcase, and two opposite portions of the attached panels lay flat against side surfaces of the suitcase when the wrap-around garment bag is securely attached to the suitcase.

In one aspect, each of the plurality of straps comprise an adjustable strap for adjusting the length of each strap.

In another aspect, the first pair of straps extend in parallel with each other from a first edge of the attached panels, the second pair of straps extend in parallel with each other from a second edge of the attached panels, opposite the first edge, and the third pair of straps including a first side strap extends from a first side edge of the attached panels, and a second side strap extends from a second side edge of the attached panels, opposite the first side edge.

In another aspect, each quick release fastener includes any of a female buckle and a male buckle, a magnet, a snap, a clasp, a hood, a button arrangement or a clamp.

In another aspect, the at least one hook opening formed within the attached panels includes a second hook opening formed within the attached panels, opposite the at least one hook opening, and extends within the storage compartment.

In another aspect, the garment hanger includes one or more garment hangers each having an S-shaped hook that moves through either or both hook openings, or one or more conventional garment hangers each having a curved hook that moves through either or both hook openings.

In another aspect, each hook opening includes a flap closure for covering each hook opening.

In another aspect, the wrap-around garment bag further includes a plurality of bands extending sequentially in parallel within the storage compartment to retain garments.

In another aspect, each S-shaped garment hanger includes a neck having an aperture for receiving the S-shaped hook, where each S-shaped hook slides freely within the corresponding aperture.

In another aspect, the wrap-around garment bag further includes a storage pocket provided on the outer surface of said first panel for storing personal items therein, where the storage pocket is accessible by users when the wrap-around garment bag is fully attached to the outer surface of any suitcase.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The term, "suitcase" as used herein, refers to any of a suitcase, luggage, trunk, upright spinner, or other storage container generally used by travelers for storing, carrying, and transporting garments, clothing, and personal items, and that may or may not include one or more fixed handles, telescoping handles, and wheels.

Shown throughout the figures, the present invention is directed to a universal, wrap-around garment bag that includes a zippered storage compartment for storing garments, a storage pocket provided on one panel for storing small personal items, and a plurality of adjustable straps each including a quick release male/female buckle for attaching the wrap-around garment bag to the outer surface of a suitcase of any size. A pair of garment hangers are provided at opposite ends of the garment bag for holding clothes.

Figure 1:
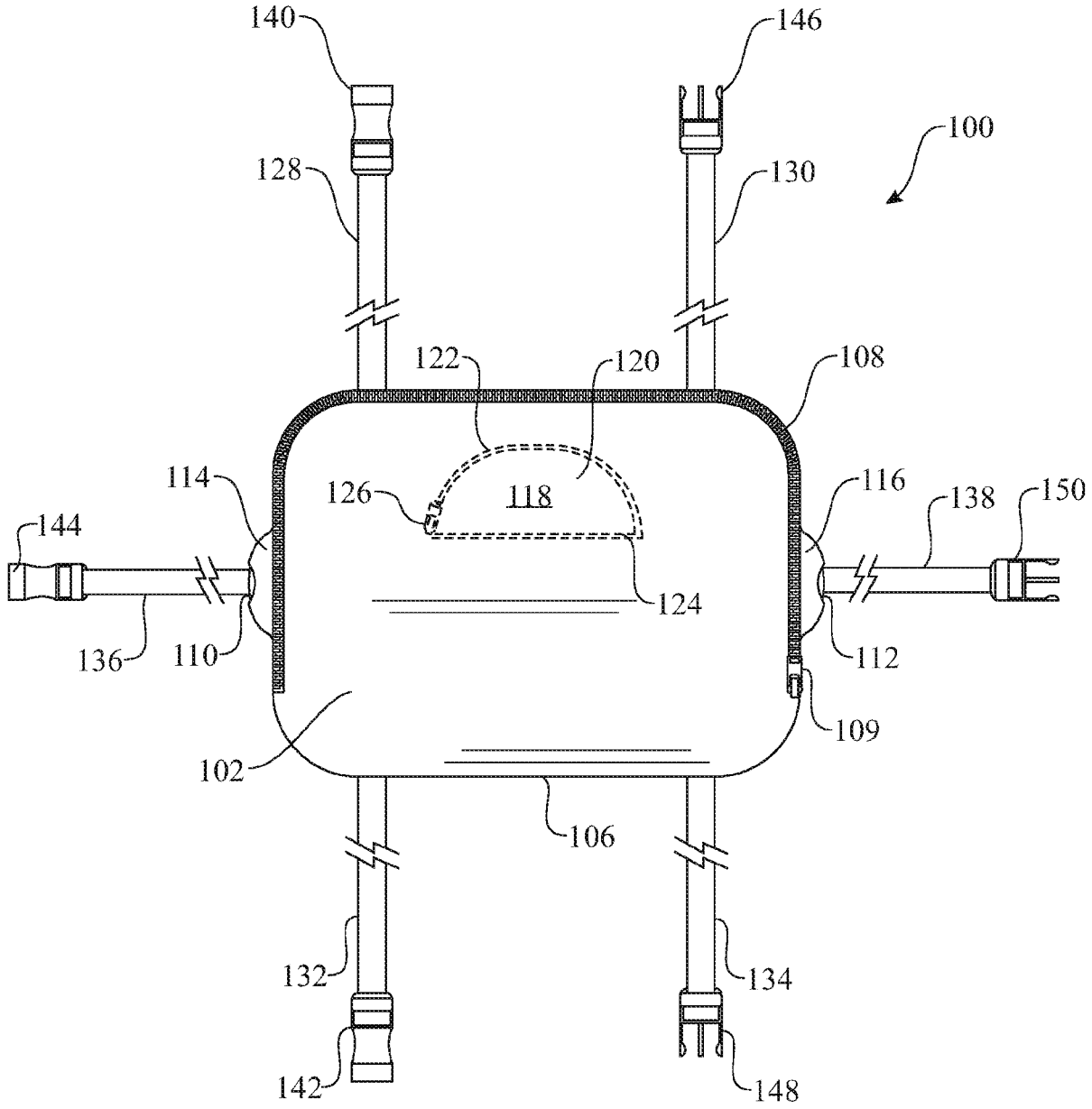
FIGS. 1 and 2 present a back and front view, respectively, of a universal, wrap-around garment bag showing a zippered storage compartment for storing and transporting garments in a wrinkle-free manner, a storage pocket for storing a variety of personal items, and a plurality of adjustable straps including quick release buckles for attaching the garment bag to any suitcase, in accordance with one embodiment of the present invention.
Figure 2:
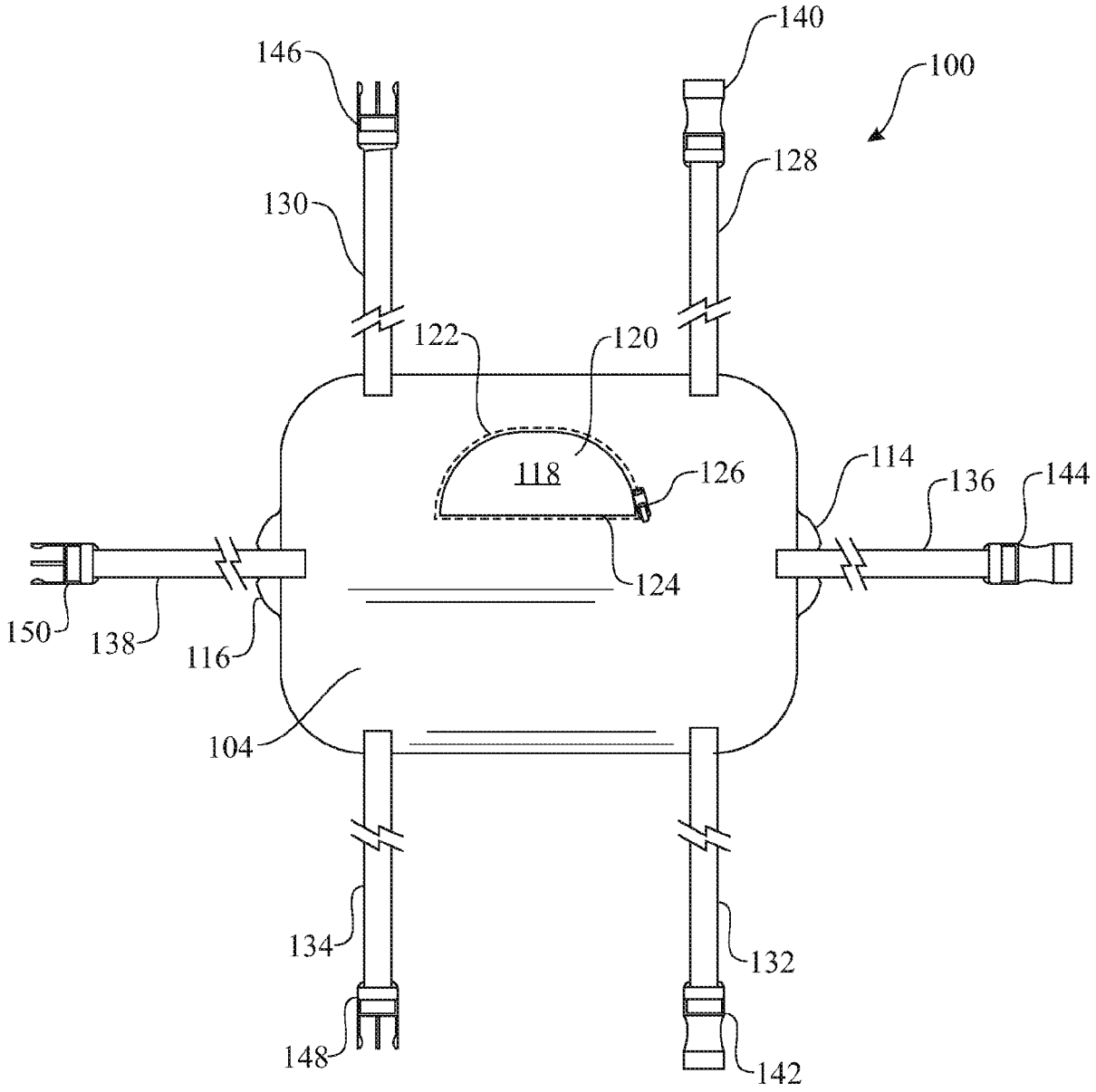

Referring now to FIGS. 1 and 2, there are shown a back and front view, respectively, of a wrap-around garment bag 100 for storing and carrying garments or clothes and other personal items, where the garment bag 100 is removably attached to the outer surface of a suitcase comprising any shape, or size, in accordance with one embodiment of the present invention. The wrap-around garment bag 100 includes a pair of panels 102, 104 that are affixed together by a stitched seam provided along a portion of the peripheral edge 106, and a fastener such as a zipper 108 that extends along three sides of the perimeter of the garment bag 100 to allow opening the panel 102 when the zipper 108 is unzipped via, the zipper slider 109 to facilitate packing and removing clothes into, and taking clothes out from, the storage compartment. It is appreciated that the geometrical and dimensional features of the garment bag 100 may comprise any configuration, size, and shape to provide a most effective, and efficient means of storing and carrying clothes. As such, panels 102, 104 may comprise any dimensional shape including for example, a square shape, a rectangular shape, an oval shape, an ellipse shape, an elongated oval or oblong shape, or a rounded shape, having any width, length, or diametrical size. In one exemplary dimension, each panel 102, 104 comprises 31 inches in length, and 23 inches in width forming an elongated oval-shape so that when the panels 102, 104 are affixed together, form an elongate, oval garment bag 100 allowing users to dispose clothes on a hanger at both ends of the garment bag 100, as described herein. Each panel 102, 104 may be fabricated from any smooth and/or resilient material including, but not limited to, a woven or non-woven fabric, textile, or cloth, nylon, leather, plastic, polyester, silk, cotton, spandex, or any combination thereof. It is appreciated that each panel 102, 104 may also comprises a water-resistant or water-repellant material or coating to prevent water from migrating into the storage compartment of the garment bag 100 and saturate the stored clothes. The zipper 108 may comprise any of metal, nylon or plastic, and can include a single zipper slider 109 or a double zipper slider to allow travelers to unzip the zipper 108 from either end, if preferred.

Figure 3:
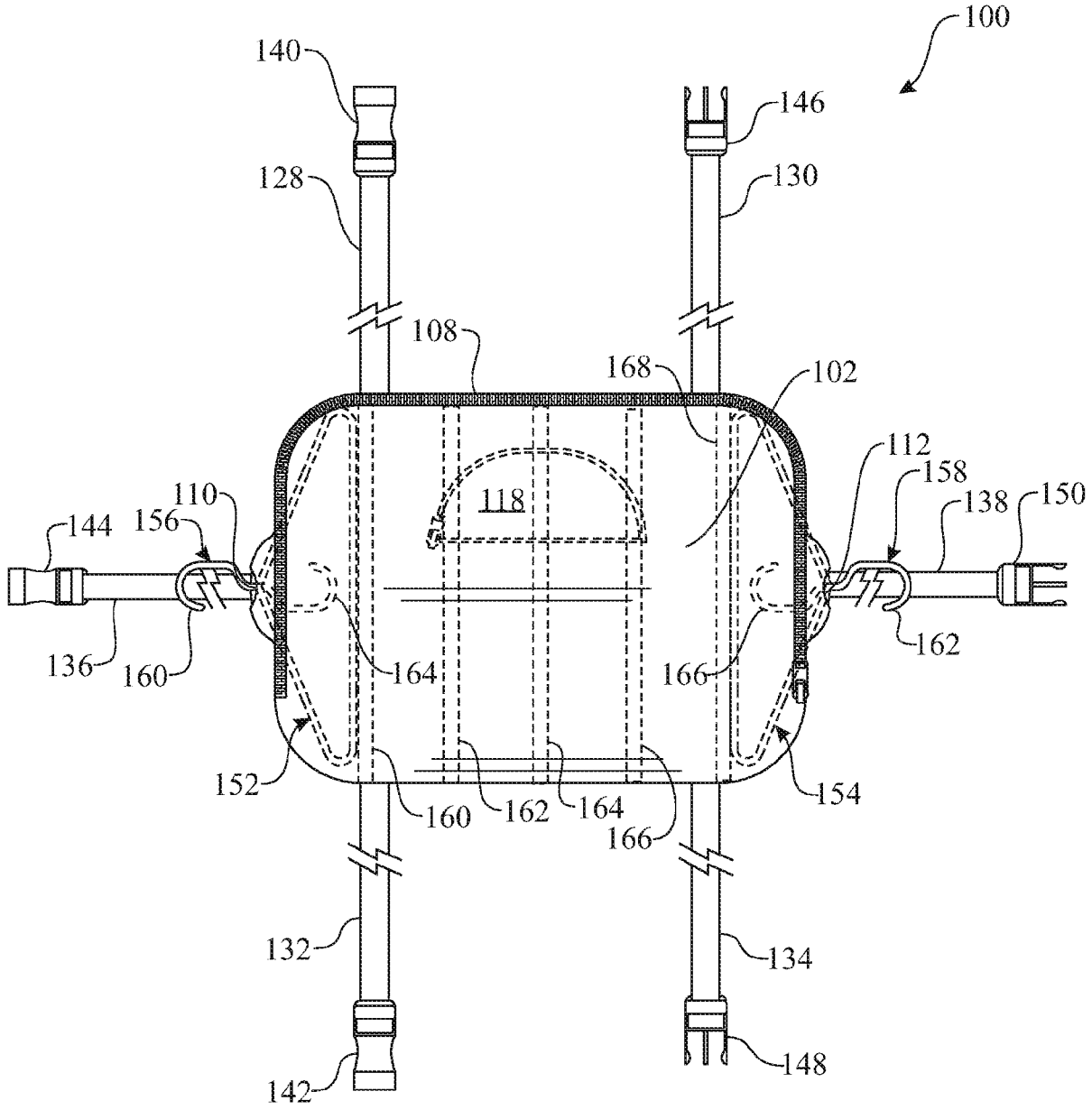
FIG. 3 presents a back view of the wrap-around garment bag of FIG. 1, showing a pair of hangers provided at opposite ends within the storage compartment, where each hanger includes a curved hook extending through a hook opening provided on opposite ends of the garment bag, and a plurality of bands sequentially parallel with each other and provided within the storage compartment to hold garments stored within the storage compartment.

The garment bag 100 also includes a pair of hook openings 110, 112 provided on opposite sides of the garment bag 100 to permit translating movement of S-shaped hooks 156, 158, of garment hangers 152, 154, as better illustrated in FIG. 3. A pair of soft or rigid flaps 114, 116 are provided adjacent the hook openings 110, 112 to close each opening 110, 112, and cover the hooks 156, 158 when inserted within the garment bag 100. In one embodiment, each flap 114, 116 may be defined by a pair of semi-circular segments integrally formed with each respective panel 102, 104 so that when the panels 102, 104 are affixed together, the semi-circular segments are stitched along the outer peripheral edge of each semi-circular segments terminating at openings. As such, each flap 114, 116 may comprise the same integral material as panels 102, 104, or alternatively comprise material that is separately attached to the panels 102 and 104 adjacent the hook openings 110, and 112. In one alternative embodiment, the garment bag 100 may include removable flaps 114, 116 that are attached to the panels 102, 104 via, a zippers, snaps, hook and loop, or buttons.

With continued reference made to FIGS. 1 and 2, the garment bag 100 further includes a plurality of adjustable straps 128, 130, 132, 134, 136, 138, illustrated in a broken view to indicate straps of any length. The straps are used to removably attach the garment bag 100 to the outer surface of a suitcase 200 or 300 with ease. The plurality of adjustable straps defines a first pair of straps 128, 130, a second pair of straps 132, 134, and a third pair of straps 136, 138 that include quick release male/female buckles for quick, releasable attachment of each pair of straps 128, 130, 132, 134, 136, and 138. Each strap includes a proximate end permanently attached to designated areas on one panel 104, via a stitching process, and a distal end that includes a quick release buckle comprising a female buckle 140, 142, 144 for releasable engagement with a male buckle 146, 148, and 150. In one embodiment, each strap 128, 132, 130, 134, 136, 138 may comprise any length, width, and thickness, and is constructed from any of leather, nylon, cotton, woven or non-woven fabric, textile or cloth, rubber, bungee, a stretchable or resilient material, or any combination thereof. In one preferred embodiment, each strap 128, 132, 130, 134, 136, 138 comprises an adjustable strap buckle to allow adjusting the length of the strap for attaching the wrap-around garment bag 100 to suitcases having differing sizes. Alternatively, in one embodiment, each female buckle 140, 142, 144, or each male buckle 146, 148, 150 may include a strap slot that is integrally formed with the body of the male or female buckle to allow passage of a strap to easily and quickly adjust the length of each strap 128, 132, 130, 134, 136, and 138. It is appreciated that the female 140, 142, 144 and male 146, 148, 150 buckles may comprise any well-known quick release buckle arrangement constructed from a durable plastic or resin material. Also, the female 140, 142, 144 and male 146, 148, 150 buckles may be replaced with other types of fasteners such as magnets, snaps, buttons, clasps, clamps, or hooks.

In reference to FIG. 2, the garment bag 100 includes one or more small storage pockets 118 provided on the outer surface of panel 102 and/or 104 for added convenience of storing small personal items therein such as keys, a mobile phone, sunglasses, music discs, headphones, or a small book. As the garment bag 100 is attached to the outer surface of a suitcase 200, 300, the garment bag 100 may obstruct access to storage pockets provided on the suitcase itself. As such, to overcome this inconvenience, a storage pocket 118 is employed on the outer surface of the garment bag 100 to give travelers the ability to accessibly store items therein, and provide quick and easy access to such stored items without having to remove the garment bag 100 to access a storage pocket found on the suitcase 200, 300, and without causing additional bulk. In one embodiment, the storage pocket 118 comprises a semi-circular flap 120 having an arcuate perimeter 122 integral with a lateral edge 124 where the flap 120 pivots open when unzipping a fastening zipper via, zipper slider 126. The storage pocket 118 may comprise any shape and dimension for storing a variety of items or personal objects. In one example, a storage pocket 118 may comprise a rectangular shape having a rounded bottom for specifically holding and storing a bottle therein, or include a larger, square storage pouch for storing and holding a cap, or electronic tablet. It will be understood that any number of storage pockets 118 having the same or different shape, size, and dimension may be provided anywhere on the outer or inner surface of each panel 102, and/or 104.

Figure 7:
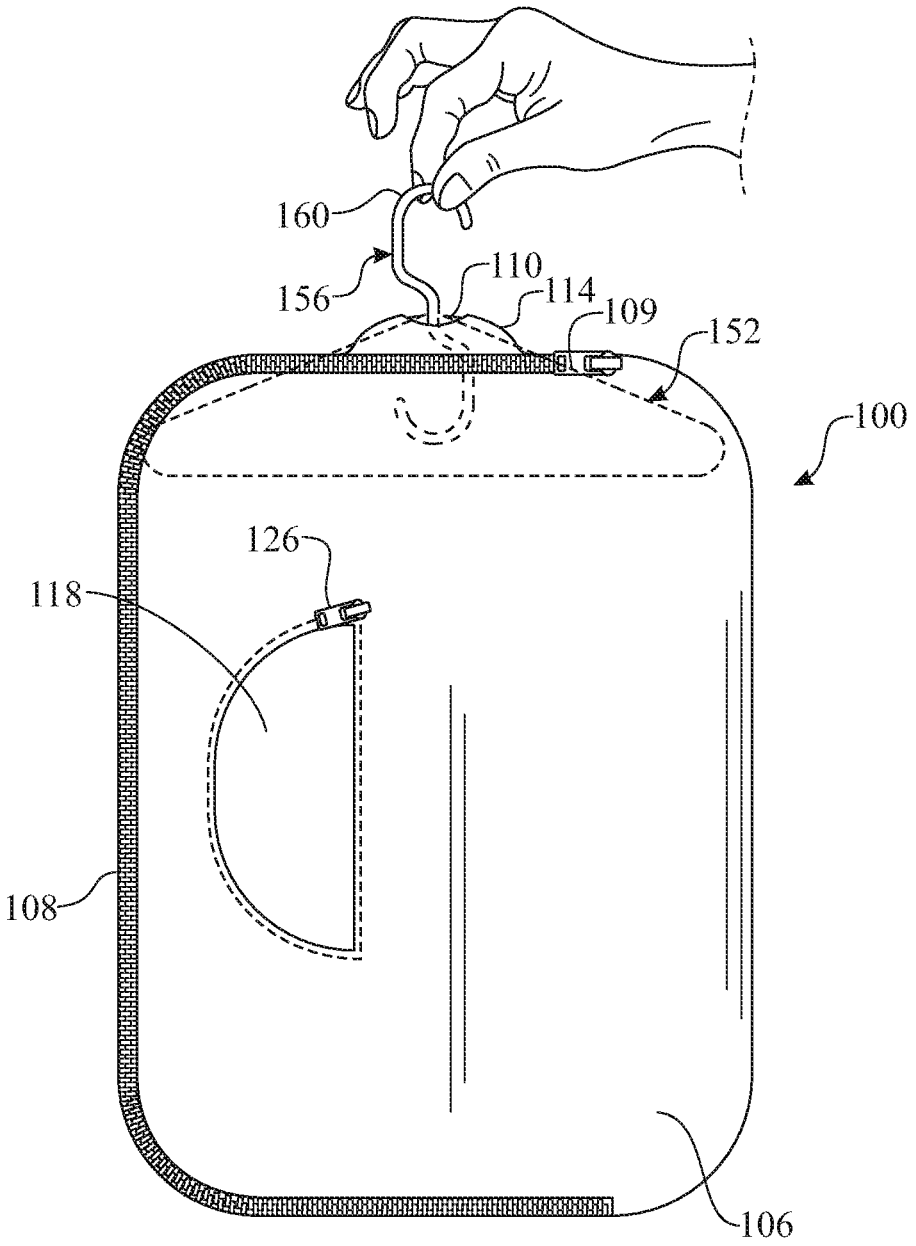
FIG. 7 presents an elevated, front view of the wrap-around garment bag of FIG. 1, showing a partial view of a person's hand holding an S-shaped hook of a hanger for readily hanging the wrap-around garment bag.

With reference now made to FIG. 3, a pair of hangers, denoted at 152, 154 may be used with the garment bag, at opposite ends of the garment bag 100, to maximize the number of garments that can be stored and placed in the garment bag 100 while minimizing the thickness or bulkiness of the garment bag 100. In one embodiment, each hanger 152, 154 includes a lateral bar, and sidebars that slope upwards from opposite ends of the lateral bar terminating together to form a neck, as commonly constructed with well-known hangers. An S-shaped hook, generally denoted at 156, and 158, is disposed within a hook aperture formed within the neck of each hanger 152, and 154. Each S-shaped hook 156, 158 includes a top curved portion 160, 162 each integral with a bottom curved portion 164, and 166. The top curved portion 160, 162, of each S-shaped hook 156, 158, can be pushed down and pulled up freely, through the hook aperture provided in the neck of each hanger 152, 154. The sliding movement of the top curved portion 160, 162 allows travelers to insert and store each top curved portion 160, 162 within corresponding hook opening s 110, 112, and permit each hanger 152, 154 to remain in place within the garment bag 100 thus retaining the garments or clothes in place reducing wrinkles that often occur when the hangers themselves move. Each bottom curved portion 164, 166 is designed to prevent the S-shaped hooks 156, 158 from completely slipping out from the hook aperture provided in the necks of each hanger 152, and 154. Upon detaching the garment bag 100 from a suitcase, users can easily grasp and pull any top curved portion 160, 162, of each S-shaped hook 156, 158 from respective openings 110, 112 to extend the portions 160, 162 outwards from the hook openings 110, 112 to carry and hang the garment bag 100 on a closet rod, or door handle, as shown in FIG. 7. In one alternative embodiment, a series of hanger straps (not shown), or hanger bands with fasteners such as snaps, magnets, buttons, or miniature buckles, can be sewn to, or removably attached to, the inner surface of panel 102, and/or 104 to firmly retain the hangers 152, 154 in place within the garment bag 100 to prevent the hangers 152, 154 from moving or shuffling. It will be appreciated that each hanger 152, 154 may be replaced with conventional or traditional hangers having a well-known curved hook where hanger straps are employed to retain the conventional hangers in place. It will be understood that hangers 152, 154, and/or conventional hangers may be constructed from a plastic material to reduce weight.

Figure 4:
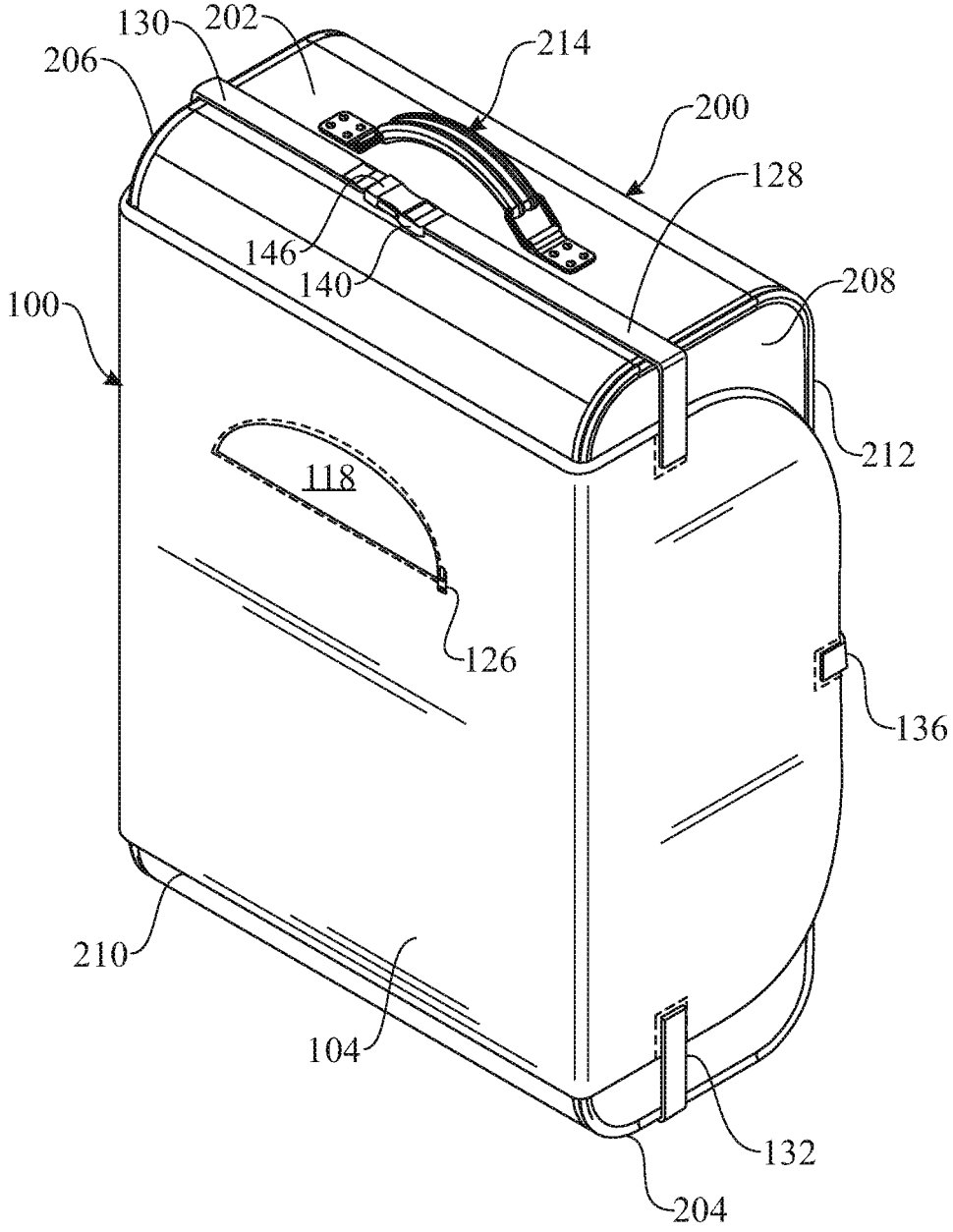
FIG. 4 presents a front perspective view of the wrap-around garment bag of FIG. 1, shown attached to the outer surface of a suitcase including a fixed handle, in which the plurality of adjustable straps includes a first pair of straps attached together over a top surface of the suitcase, a second pair of straps attached together under a bottom surface of the suitcase, and a third pair of straps attached together over a planar back surface of the suitcase.
Figure 5:
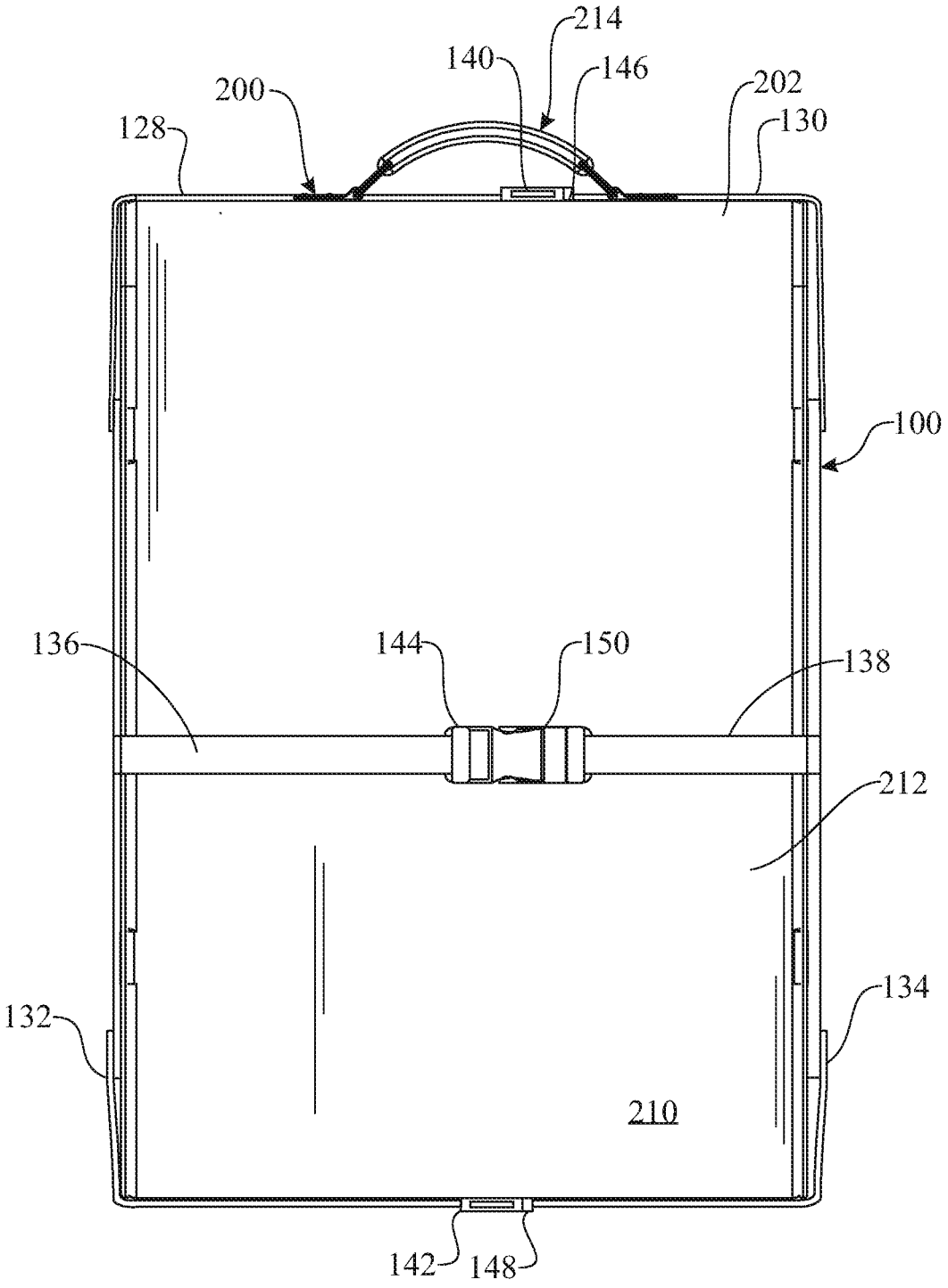
FIG. 5 presents a back view of the suitcase of FIG. 4 with the wrap-around garment attached to the suitcase, showing the third pair of straps attached together over the planar, back surface of the suitcase.

Turning now to FIGS. 4 and 5, there are shown a front perspective view, and a back view, respectively, of a wrap-around garment bag 100 removably attached to the outer surface of suitcase 200, in accordance with one embodiment of the present invention. Suitcase 200 comprises a generally well-known handheld or carry-on suitcase that includes a top panel 202, a bottom panel 204, two side panels 206, 208, a front panel 210, and a back panel 212 that are all joined to each other to form a storage chamber having a predetermined width, height, and depth for storing garments or clothes, and other personal items therein. In this embodiment, suitcase 200 includes a carrying handle 214 that is permanently affixed to the top panel 202, and does not employ the use of wheels. The wrap-around garment bag 100 is attached to the outer surface of the suitcase 200 so that a central portion of the panel 102 butts flat against the front panel 210 of the suitcase 200, and two other portions of the panel 102 wrap around opposite sides 206, 208 of the suitcase 200 where the enclosed hangers 152, 154 press flat against the planar side surfaces 206, and 208 to reduce or decrease wrinkles or creases in the clothes, as better illustrated in FIG. 6 with regards to an alternative suitcase 300. It is appreciated that in this configuration, the peripheral zipper 108 of the garment bag 100, as shown in FIG. 1, is directed inwards towards the front panel 210 of the suitcase 200 thus restricting unauthorized access to the zipper slide 109 to access the contents stored in the wrap-around garment bag 100. Upon initially attaching the wrap-around garment bag 100 to the outer surface of the suitcase 200, a first pair of straps 128, 130 are positioned over the top panel 202 and fastened together via, the quick release female 140 and male 146 buckle arrangement. A second pair of straps 132, 134 are displaced under the bottom panel 204 of the suitcase 200, and fastened together via, the quick release female 142 and male 148 buckle, and a third pair of straps 136, 138 are laid across the back panel 212 of the suitcase 200 and fastened together via, the quick release female 144 and male 150 buckle, as better illustrated in FIG. 5. It will be understood that the female 144 and male 150 buckle may be disposed closer to the peripheral edge of the back panel 210 if preferred to further unobstruct the back panel 210. This may be achieved by shortening the length of strap 138 and increasing the length of strap 136 to shift the connected buckle 144/150 arrangement closer to the perimeter of the back panel 210. The positional layout of the first pair of straps 128, 130, second pair of straps 132, 134, and third pair of straps 136, 138 secures the wrap-around garment bag 100 onto the outer surface of the suitcase 200 while providing opposed tension on the panels 102, 104 in a manner that prevents the garment bag 100 from slipping off, or shifting on the suitcase 200, while ensuring the garment bag 100 remains securely fastened in place without hindering the operational use of the carrying handle 214. As seen in FIG. 5, when the wrap-around garment bag 100 is fully attached to the suitcase 200, the planar back panel 212 of the suitcase 200 remains unencumbered making it easier for travelers to lay and/or slide the back end 212 of the suitcase 200 on an airport security belt, an overhead luggage bin, on a floor, or in a trunk of a car, without imposing impact force on the clothes that is stored in the garment bag 100 allowing the clothes to remain in-tack, and less prone to wrinkles. The wrap-around garment bag 100 may be attached to a variety of differently sized suitcases by simply adjusting the length of any of the straps 128, 130, 132, 134, 136, and 140. As shown in FIG. 4, when the wrap-around garment bag 100 is attached to the outer surface of the suitcase 200, travelers can access the storage pocket 118 provided on one of the panels 104 of the garment bag 100 to store or retrieve personal items.

Figure 6:
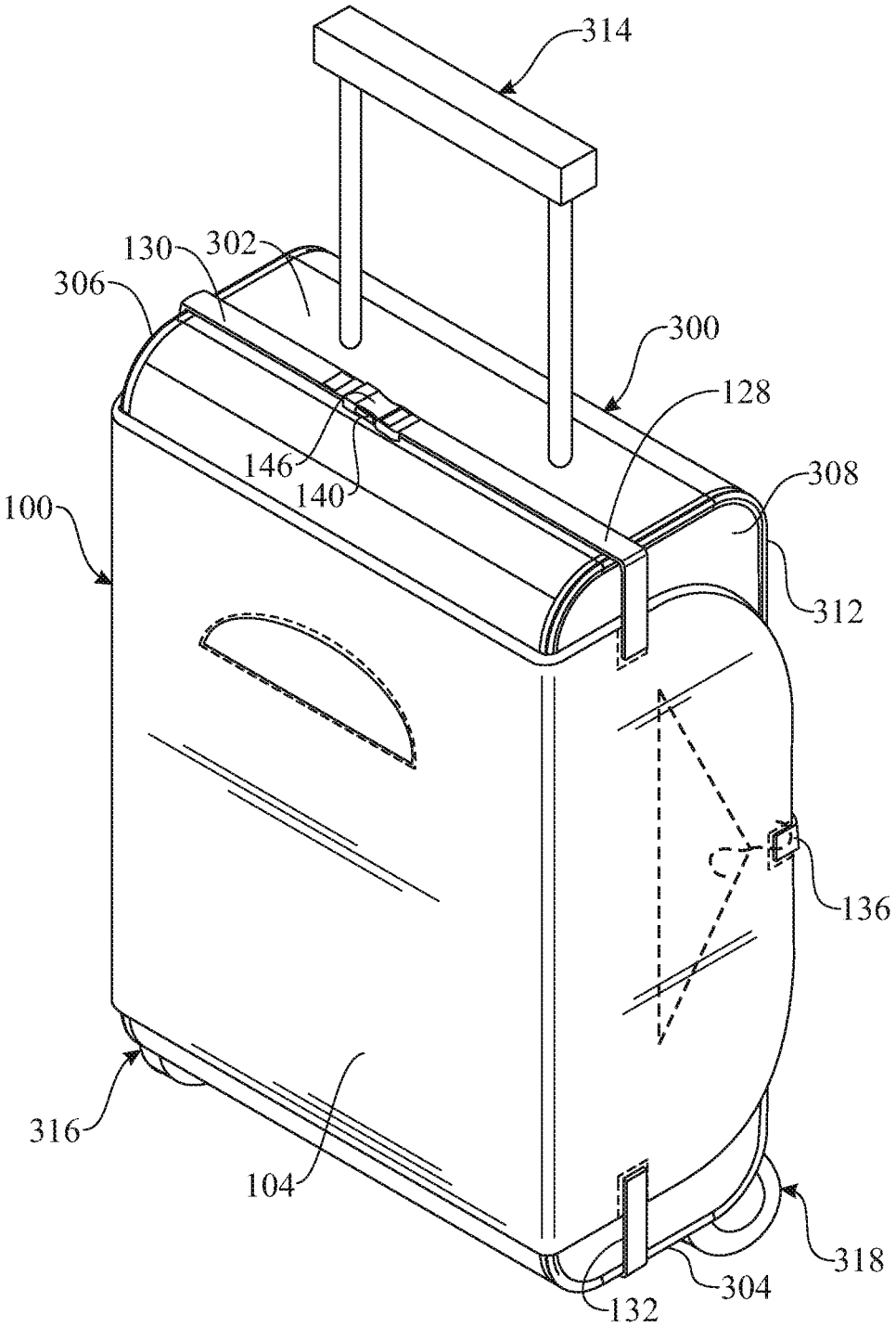
FIG. 6 presents a front perspective view of the wrap-around garment bag of FIG. 1, shown attached to the outer surface of a suitcase including wheels, and a telescoping handle, in which the plurality of adjustable straps includes a first pair of straps attached together over a top surface of the suitcase, a second pair of straps attached together under a bottom surface of the suitcase, and a third pair of straps attached together over a planar, back surface of the suitcase.

With reference now made to FIG. 6, there is shown a front perspective view of a wrap-around garment bag 100 removably attached to the outer surface of an alternative suitcase 300. Suitcase 300 includes a top panel 302, a bottom panel 304, two side panels 306, 308, a front panel 310, and a back panel 312 that are all joined together to form a storage compartment having predetermined width, height, and depth for storing clothes and personal items therein. In this embodiment, suitcase 300 includes a modern style suitcase having a telescoping handle 314, and a pair of wheels 316, 318 disposed on the bottom panel 304 of the suitcase 300 to allow travelers to easily roll the suitcase 300 over a surface during transport. The wrap-around garment bag 100 is attached to the outer surface of the suitcase 300 such that a central portion of panel 102, as shown in FIG. 1, lays flat against the planar front panel of the suitcase 300, and opposite portions of the panel 102 wrap around opposite sides 306, 308 of the suitcase 300 disposing the enclosed hangers 152, 154 flat across the planar side surfaces 306, and 308 to reduce and decrease wrinkles or creases formed in clothes stored within the garment bag 100. It is appreciated that the peripheral zipper 108 of the garment bag 100, as shown in FIG. 1, also faces inwards towards the front panel of the suitcase 300 thus restricting unauthorized access to the contents of the garment bag 100. In attaching the wrap-around garment 100 to the suitcase 300, a first pair of straps 128, 130 are positioned over the top panel 302 of the suitcase 300, and fastened together via, a quick release female 140 and male 146 buckle. A second pair of straps 132, 134 are positioned under the bottom panel 304 and fastened together via, the quick release female 142 and male 148 buckle, and a third pair of straps 136, 138 are laid across the planar back panel 312 of the suitcase 300 with the female 144 and male 150 buckle attached together, similar to that illustrated in FIG. 5. The positional layout of the first pair of straps 128, 130, second pair of straps 132, 134, and third pair of straps 136, 138 secures the wrap-around garment bag 100 to the suitcase 300 preventing the garment bag 100 from slipping off, or shifting along, the suitcase 300 thus further preventing wrinkles or creases in the clothes or garments. It is appreciated that the pulling forces of the straps 128, 130, 132, 134, 136, 138, also provide opposing tension on the garment bag panels 102, 104 to help maintain the stored clothing taught, and wrinkle-free. In similar reference to FIG. 5, when the wrap-around garment bag 100 is fully attached to the suitcase 300, the planar back panel 312 of the suitcase 300 remains unencumbered by the wrap-around garment bag 100 thus making it easier for travelers to lay and/or slide the suitcase 300 on an airport security belt, an overhead luggage bin, on a floor, or in a trunk of a car while the garments remain in-tack and less prone to wrinkles as a result of there being no impact forces, shuffling, or external pressures or weight applied to opposite side panels 306, 308, and front panel 310 of the suitcase 300. Upon attaching the wrap-around garment bag 100 to suitcase 300, the functional aspects of both the telescoping handle 314, and the wheels 316, 318 are not compromised or obstructed in any way. Moreover, the three sided wrap around design of the garment bag 100 can also be employed with suitcases that have four wheels, as such modern wheeled suitcases can easily maintain mobility by tilting the suitcase to solely engage the two back wheels.

Upon arriving at one's destination, travelers can quickly release the female 140, 142, 144 and male buckles 146, 148 and 150 of the garment bag 100, and grasp one top curved portion 160 of an S-shaped hook 156, of hanger 152, with one hand to extend the top curved portion 160 through the hook opening 110 to hang the wrap-around garment bag 100 onto a clothing rod provided in a closet, or onto a door handle. Travelers may grasp the top curved portion 160, 162 of either hanger 152, 154 to hang the wrap-around garment bag 100 upright. Upon properly hanging the garment bag 100, users can maneuver the zipper slider 109 to unzip the zipper 108 and gain access to clothes stored on one or both hangers 152, and 154.

The wrap-around garment bag 100 may include additional features or elements without departing from the scope of the invention. For example, the garment bag 100 may include a designated tag pocket including a transparent window for inserting a traveler's name tag that is viewable through the transparent window. The tag pocket may be disposed on the outer surface of any of the panels 102, and 104. Alternatively, one or more rings may be attached to one or both panels 102, 104 for attaching the traveler's name tag. The wrap-around garment 100 may also include a handle provided on the outer surface of one or both panels 102, and 104 to carry the garment bag by hand. Further, the wrap-around garment bag 100 may include an adjustable shoulder strap to carry the garment bag 100 over a traveler's shoulder. In one embodiment, a pair of rings may be attached to opposite sides of the outer surface of either panel 102, 104 to permit releasable attachment of the should strap. It is appreciated that the wrap-around garment bag 100 may come in a variety of different colors, patterns, and designs, and include any logos, indicia, characters, symbols, numbers, letters, words, phrases, or expressions.

With reference to FIGS. 8-11, there is shown a wrap-around garment bag 400 for storing and carrying garments or clothes and other personal items in accordance with a secondary embodiment of the present invention. Structural elements of the wrap-around garment bag 400 are numbered the same as the structural elements of the wrap-around garment bag 100 but preceded by the '4.' The wrap-around garment bag 400 includes a pair of panels 402, 404 that are affixed together by a stitched seam provided a long a portion of the garment's peripheral edge 406, and a zipper or the like that extends along at least three sides of the perimeter of the garment bag 400 to allow opening the panels and give access to a storage compartment. Each panel 404, 406 may be fabricated from any smooth and/or resilient material, including, but not limited to, a woven or non-woven fabric, textile, cloth, nylon, leather, plastic, or any combination thereof. Each panel may also comprise a water-resistant or water-repellant material or coating to prevent water from migrating into the storage compartment of the garment bag 400 and saturate or otherwise ruin the stored clothes.

The garment bag 400 also includes a pair of hook openings 410, 412 provided on opposite sides of the garment bag 400 to permit translating movement of S-shaped hooks or conventional garment hooks. Each hook opening includes a pair of soft or rigid flap 414, 416 adjacent the hook openings to cover the hooks when inserted within the garment bag 400. In one exemplary embodiment, each flap 414, 416 may be defined by a pair of semi-circular segments integrally formed with at least one respective panel, with the flap stitched or otherwise attached to the peripheral edge of the panel. In one particular embodiment, the flap may include a zipper to prevent or allow access into the storage compartment of the garment bag 400 through the flaps 414, 416. In alternative embodiments, the flap may include snaps, hook and loop, buttons, or other alternative fasteners that selectively allow and deny access into the storage compartment.

Figure 8:
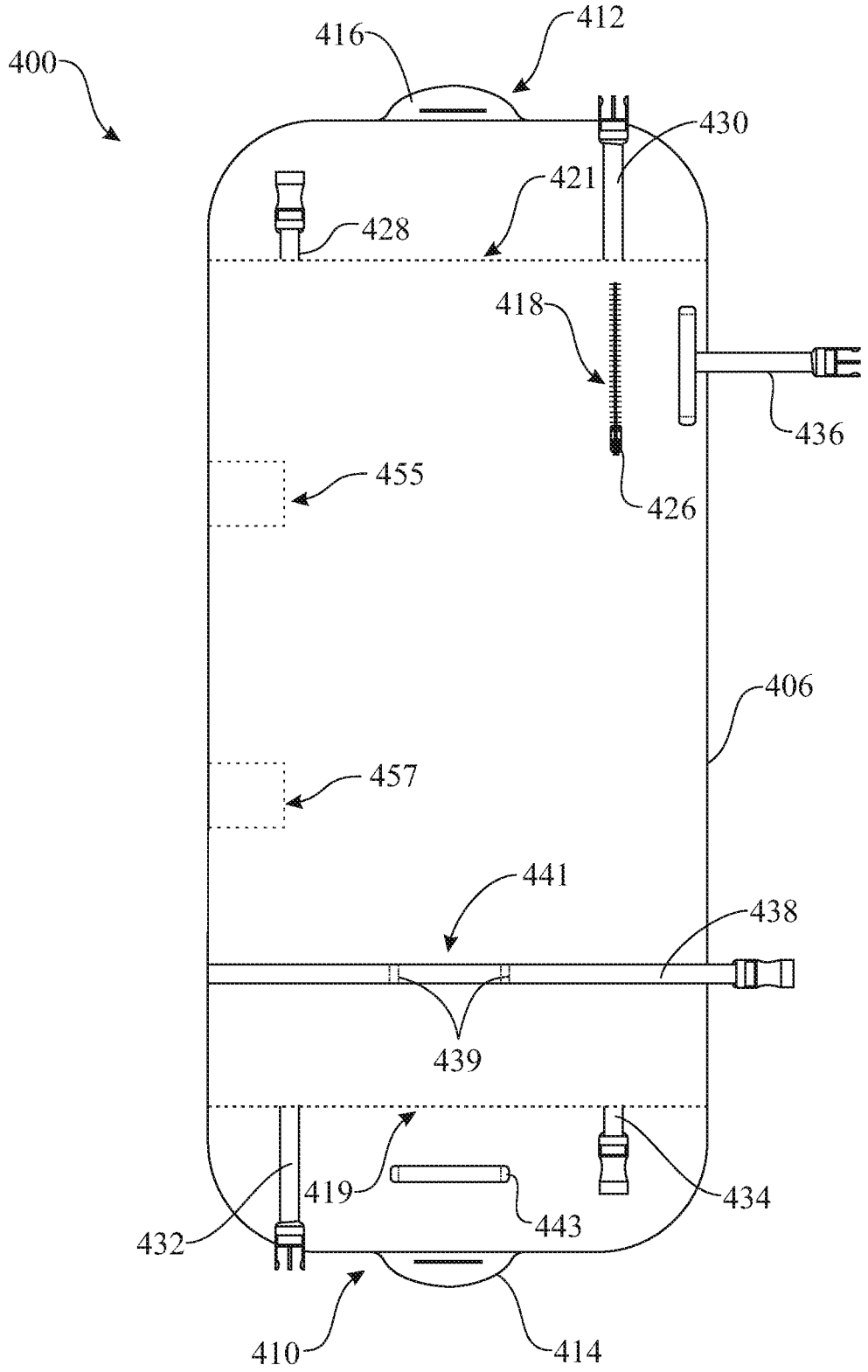
FIGS. 8 and 9 present a second embodiment of the wrap-around garment bag, showing a zippered storage compartment for storing and transporting garments in a wrinkle-free manner, a storage pocket for storing a variety of personal items, and a plurality of adjustable straps including quick release buckles for attaching the garment bag to any suitcase, in accordance with one embodiment of the present invention.

With Reference to FIG. 8, the garment bag 400 includes a plurality of adjustable straps 428, 430, 432, 434, 436, 438. Although the straps are not shown in broken view to indicate straps of any length, as shown in FIG. 1, one will appreciate that the lengths of the straps will vary depending on the need. The straps, like the straps in the garment bag 100, are used to removably attach the garment bag 400 to the outer surface of a suitcase 200 or 300 with ease. The plurality of adjustable straps defines a first pair of straps 428, 430, a second set of straps 432, 434, and a third pair of straps 436, 438, with each pair of straps including quick release male/female buckles for releasable attachment of each strap to the suitcase. Each strap includes a proximate end permanently attached to a designated area on a panel, via stitching, and a distal end that includes a quick release buckle, be it a male or female buckle. As illustrated, the first pair of straps may include a first strap 428 being shorter in length than the second strap 430. The second pair of straps 432, 434 may comprise a similar, yet inverse, configuration as the first pair of straps 428, 430. The third set of straps 436, 438 may include a first strap 436 that is shorter in length than the second strap 438, however, the first strap 436 extends further past the peripheral edge 406 of the garment bag 400 than the, longer, second strap 438. The second strap 438 is attached, or otherwise stitched, at certain points 439 to the panel of the garment bag 400, creating a handle 441 or strap slot that is disposable over a suitcase handle 314 (as seen on FIG. 11).

The garment bag 400 also includes one or more pockets 418, 419, 421 provided on the outer surface of panels 402 and/or 404. Pocket 418 is included for added convenience of storing small personal items therein such as keys, mobile phone, sunglasses, music devices, books, or other miscellaneous items. Pockets 419, 421 are provided to hide or otherwise store the unused or excess strap length of the first and second set of straps 428, 430, 432, 434, respectively. Unlike pocket 418 which includes a closing mechanism 426, such as a zipper, hook and loop, button, or the like, pockets 419 and 421 do not includes closure mechanism, and provide easy, unsecured access.

Figure 9:
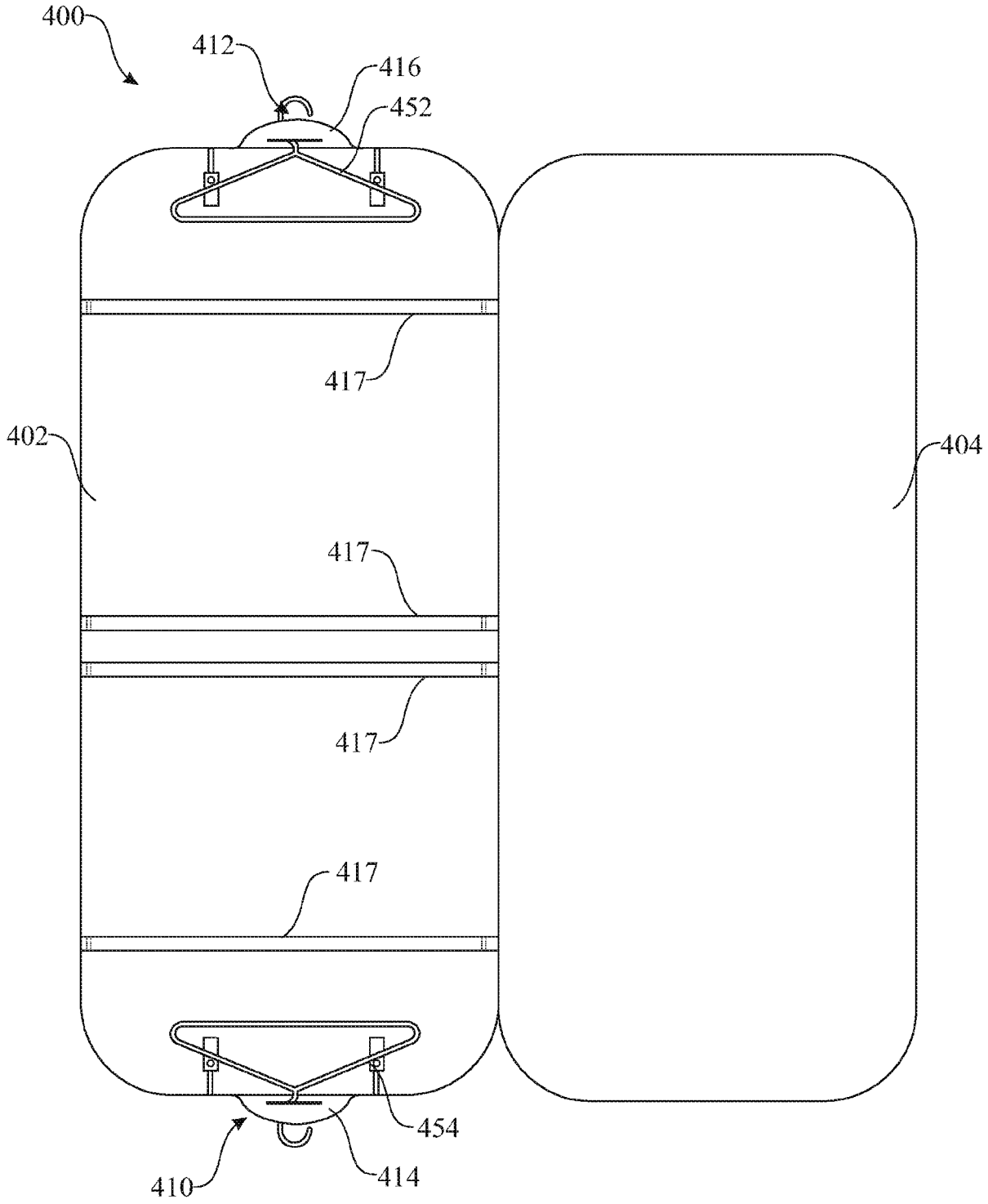

With reference now to FIG. 9, a pair of hangers 452, 454 may be used with the garment bag 400, at opposite ends of the bag, to maximize the number of garments that can be stored and placed inside the interior compartment of the garment bag 400, while minimizing the thickness and bulkiness that may result from the number of garments being stored inside the bag. The interior surface of one of the panels where the interior compartment of the bag is formed may include a plurality of spaced-apart straps in sequential order. The straps are provided and designed to hold garment or articles of clothes in place, thereby minimizing the likelihood of creases or wrinkles forming on the garments due to unwanted, unrestricted movement.

Figure 10:
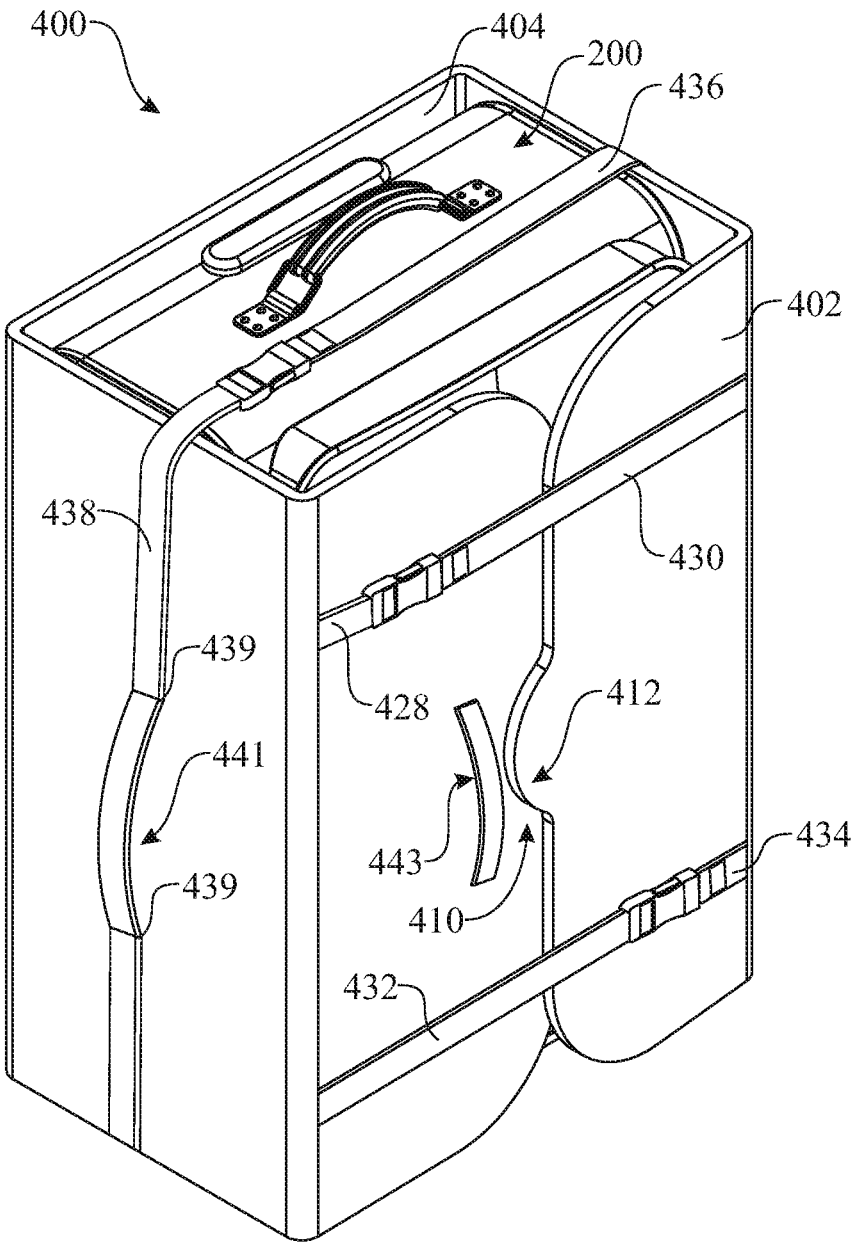
FIG. 10 presents a front perspective view of the wrap-around garment bag of FIG. 8, shown attached to the outer surface of a suitcase.
Figure 11:
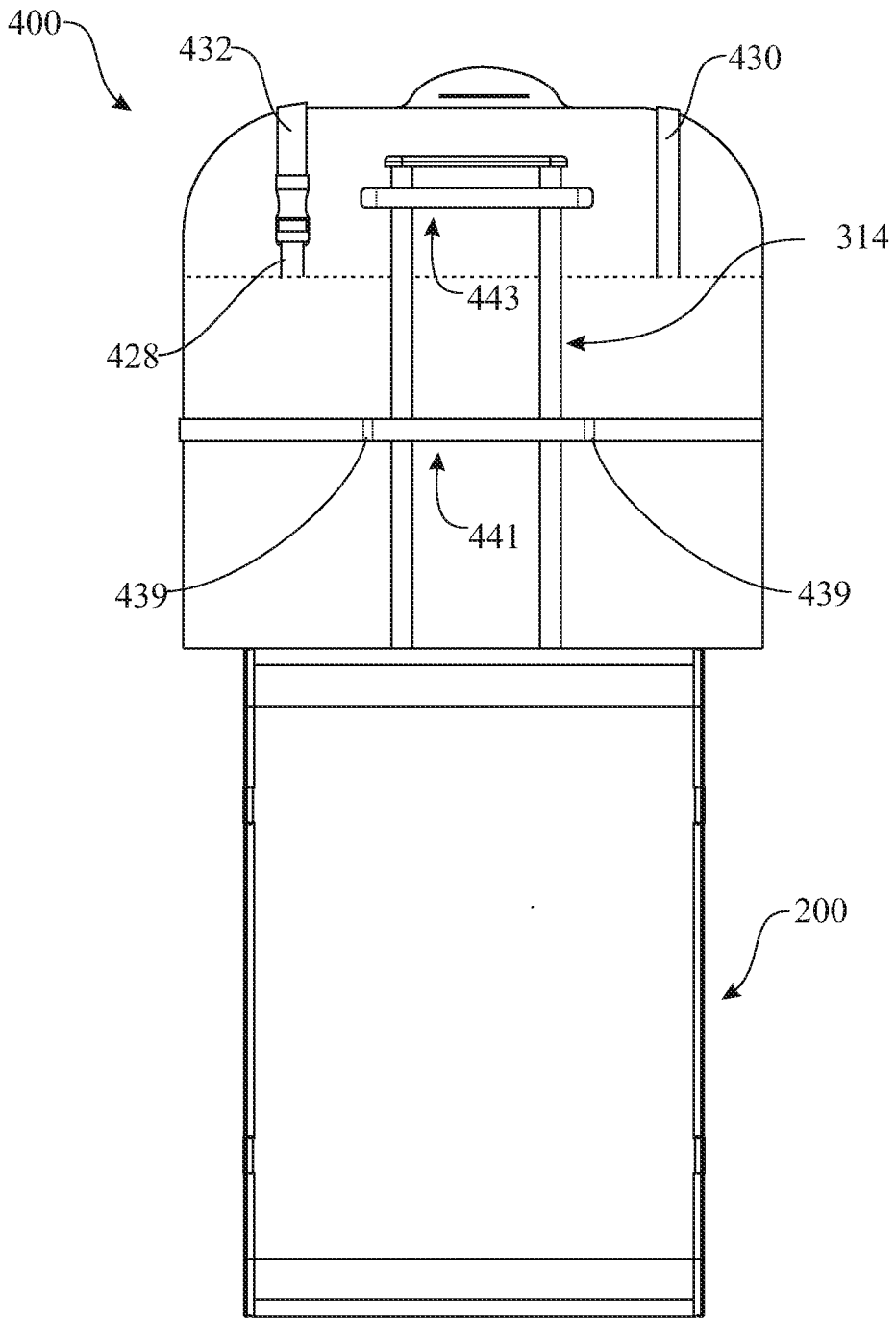
FIG. 11 presents a rear perspective view of the wrap-around garment bag of FIG. 8, shown disposed over a telescoping handle of a suitcase.

Turning now to FIGS. 8, 10 and 11, there is shown a front perspective view, and a back elevation view, respectively, of the wrap-around garment bag 400 removably attached to the outer surface of the suitcase 200. As mentioned above, suitcases generally comprise well known structural elements that include a plurality of panels joined together to form a storage chamber having a predetermined width, height, length, and depth for storing articles of clothing, garments, and other transportable items. As shown in FIG. 10, one exemplary method of how the garment bag 400 may be removably attached to the suitcase 200 is shown. In this particular embodiment, the wrap-around garment bag 400 is attached to the outer surface of the suitcase such that a central portion of panels rests or butts against a rear panel of the suitcase. Opposite portions of the panels, where the flaps 410, 412, for the hangers rest, wrap completely around the sides of the suitcase and a substantial portion of the front panel of the suitcase. In one embodiment, the length of the garment bag may be sufficiently long enough such that the end portions that include the flaps 410, 412, overlap. As illustrated, the garment bag 400 is designed or otherwise configured to closely follow the exterior profile of the suitcase it is wrapped around, reducing the bulkiness of the combination. Upon initially attaching the wrap-around garment bag 400 to the outer surface of the suitcase, the first pair of straps 428, 430, and the second pair of straps 432, 434, are positioned to be aligned with each other, as shown in FIG. 10, and fastened together, via the quick release buckle arrangements. The third set of straps 438, 436 are positioned to run over the top panel of the suitcase, where the suitcase telescopic handle is disposed, and fastened together, via the quick release buckles. In this configuration, the wrap-around garment bag 400 provides additional means to handle and carry the suitcase 200 and garment bag 400, via handle 441 disposed about a side portion on the bag, and handle 443 disposed about a front portion on the bag. With quick reference to FIG. 8, the garment bag 400 may also include a pair of cutouts 455, 457 to accommodate for the wheels of the suitcase 200 when the bag is fully wrapped around the suitcase, eliminating any obstruction that may occur to the suitcase wheels. The cutouts 455, 457 are shown in dotted lines to illustrate that in some embodiments the garment bag 400 may be devoid of them; however, in alternative embodiments the cutouts 455, 457 are part of the garment bag 400 construct.

The wrap-around garment bag 400 is foldable in multiple, useful and convenient configurations. For instance, as shown in FIG. 11, the wrap-around garment bag 400 is foldable about a center half portion along its length into a U-shaped fold. When the bag 400 is folded in the manner shown in FIG. 11, the garment bag's handle 443 and handle 441 are vertically aligned and configured to receive the telescoping handle of the suitcase 200. To prevent the bag from opening, the first pair of straps 428, 430 are selectively fastened to the second pair of straps 432, 434, via the quick release buckle arrangements. Any excess strap length are tuckable inside of pockets 419, 421 (FIG. 8). It also contemplated in one exemplary embodiment that the bag include fasteners attached or sewn to the exterior surface portion of the garment bag, so that when the bag is folded, whether it be empty or otherwise, the fasteners can be used to keep the bag in a folded position.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A wrap-around garment bag comprising:

a first panel attached to a second panel by a stitched seam extending around a section of a perimeter of the attached panels, and a zipper extending along three sides of another section of the perimeter of the attached panels, the attached panels forming a storage compartment for storing garments;

a plurality of adjustable straps defining at least a first pair of straps, and at least a second pair of straps, each strap having a proximate end attached to the first panel, and a distal end including a quick release fastener; and at least one hook opening formed within the attached panels and extending within the storage compartment for receiving a curved hook of at least one garment hanger;

wherein the wrap-around garment bag is attachable to an outer surface of a suitcase in which at least one pair of straps are extendable over a top surface of the suitcase and are releasably attached together via, the quick release fastener, and at least one pair of straps are extendable across a front surface of the suitcase and are releasably attached together via, another quick release fastener to secure the attached panels to the suitcase.

2. The wrap-around garment bag of claim 1, wherein a central portion of the attached panels of the wrap-around garment bag rest flat against the rear surface or the front surface of the suitcase, and two opposite portions of the attached panels lay flat against side surfaces of the suitcase when the wrap-around garment bag is securely attached to the suitcase, leaving either the front surface or the rear surface of the suitcase uncovered.

3. The wrap-around garment bag of claim 1, wherein each of the plurality of straps comprise an adjustable strap for adjusting the length of each strap.

4. The wrap-around garment bag of claim 1, wherein the first pair of straps extend in parallel with each other proximate a first edge of the attached panels, the second pair of straps extend in parallel with each other proximate a second edge of the attached panels, opposite the first edge, and wherein the garment bag includes a third pair of straps including a first side strap extending proximate a first side edge of the attached panels, and a second side strap extending proximate a second side edge of the attached panels, opposite the first side edge.

5. The wrap-around garment bag of claim 1, wherein the first pair of straps extend in parallel with each other proximate a first edge of the attached panels, the second pair of straps extend in parallel with each other proximate a second edge of the attached panels, opposite the first edge, and wherein the garment bag includes a third pair of straps extending parallel with each other proximate a third edge of the attached panels, the third pair of straps extending normal to the first and second pair of straps.

6. The wrap-around garment bag of claim 5, wherein at least one strap of the third pair of straps extends entirely across at least one panel and provides a handle.

7. The wrap-around garment bag of claim 1, wherein the garment bag includes at least two handles vertically aligned with one another with a first handle superior to a second handle.

8. The wrap-around garment bag of claim 1, wherein each quick release fastener includes any one of a female buckle and male buckle, a magnet, a snap, a clasp, a hood, a button arrangement, or a clamp.

9. The wrap-around garment bag of claim 1, wherein the at least one hook opening formed within the attached panels includes a second hook opening formed within the attached panels, opposite the at least one hook opening, and extending within the storage compartment.

10. The wrap-around garment bag of claim 1, wherein the garment hanger includes one or more garment hangers, each garment hanger having an S-shaped hook that moves through the at least one hook opening.

11. The wrap-around garment bag of claim 1, wherein the garment hanger includes one or more conventional hangers, each hanger having a curved hook that moves through the at least one hook opening.

12. The wrap-around garment bag of claim 1, wherein the at least one hook opening includes a flap closure for covering the hook opening.

13. The wrap-around garment bag of claim 1, wherein the garment bag further comprises a plurality of spaced-apart bands extending sequentially in parallel within the storage compartment to retain garments.

14. The wrap-around garment bag of claim 1, wherein the wrap-around garment bag further includes at least one storage pocket with a closure mechanism.

15. The wrap-around garment bag of claim 14, wherein the storage pocket is provided on an outer of the first panel, the storage pocket configured to store personal items therein, and accessible by users when the wrap-around garment bag is fully attached to the suitcase.

16. The wrap-around garment bag of claim 1, wherein the wrap-around garment further includes at least three storage pockets, a first storage pocket having a closure mechanism, and a second and third storage pocket without a closure mechanism.

17. The wrap-around garment gab of claim 16, wherein the second and third storage pocket extend parallel to one another and are disposed about opposite ends of at least one panel, and the first pocket extends normal to the second and third storage pocket.

18. The wrap-around garment bag of claim 1, wherein each panel is made out of material that is at least water resistant.

19. A wrap-around garment bag comprising:

a first panel attached to a second panel by a stitched seam extending around a section of a perimeter of the attached panels, and a zipper extending along three sides of another section of the perimeter of the attached panels, the attached panels forming a storage compartment for storing garments;

a plurality of adjustable straps defining a first pair of straps, a second pair of straps, and a third pair of straps, each strap having a proximate end attached to the first panel, and a distal end including a quick release fastener; and at least one hook opening formed within the attached panels and extending within the storage compartment for receiving a curved hook of at least one garment hanger;

wherein the wrap-around garment bag is attachable to an outer surface of a suitcase in which at least one pair of straps are extendable over a top surface of the suitcase and are releasably attached together via, the quick release fastener, and at least two pair of straps are extendable across a front surface of the suitcase and are releasably attached together via, another quick release fastener to secure the attached panels to the suitcase, and wherein a central portion of the attached panels of the wrap-around garment bag rest flat against the rear surface of the suitcase, and two opposite portions of the attached panels lay flat against side surfaces of the suitcase, and two other opposite portions of the attached panels lay flat against the front surface of the suitcase, the two other opposite portions substantially overlapping one another when the wrap-around garment bag is securely attached to the suitcase.

20. A wrap-around garment bag comprising:

a first panel attached to a second panel by a stitched seam extending around a section of a perimeter of the attached panels, and a zipper extending along three sides of another section of the perimeter of the attached panels, the attached panels forming a storage compartment for storing garments;

a plurality of adjustable straps defining a first pair of straps, a second pair of straps, and a third pair of straps, each strap having a proximate end attached to the first panel, and a distal end including a quick release fastener; and at least one hook opening formed within the attached panels and extending within the storage compartment for receiving a curved hook of at least one garment hanger;

wherein the wrap-around garment bag is attachable to an outer surface of a suitcase in which at least one pair of straps are extendable over a top surface of the suitcase and are releasably attached together via, the quick release fastener, and at least two pair of straps are extendable across a front surface of the suitcase and are releasably attached together via, another quick release fastener to secure the attached panels to the suitcase, wherein the first pair of straps extend in parallel with each other proximate a first edge of the attached panels, the second pair of straps extend in parallel with each other proximate a second edge of the attached panels, opposite the first edge, and the third pair of straps extend parallel with each other proximate a third edge of the attached panels, the third pair of straps extending normal to the first and second pair of straps, wherein the garment bag includes at least two handles vertically aligned with one another with a first handle superior to a second handle, wherein the wrap-around garment further includes at least three storage pockets, a first storage pocket having a closure mechanism, and a second and third storage pocket without a closure mechanism, and wherein the wrap-around garment includes at least two cutouts to accommodate for the suitcase's wheels.

* * * * *